US010781395B2

(12) United States Patent
Tamura

(10) Patent No.: US 10,781,395 B2
(45) Date of Patent: Sep. 22, 2020

(54) LUBRICANT COMPOSITION FOR GASOLINE ENGINE AND METHOD FOR PRODUCING SAME

(71) Applicant: IDEMITSU KOSAN CO., LTD., Chiyoda-ku (JP)

(72) Inventor: Kazushi Tamura, Kawasaki (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/320,954

(22) PCT Filed: Mar. 24, 2016

(86) PCT No.: PCT/JP2016/059455
§ 371 (c)(1),
(2) Date: Dec. 21, 2016

(87) PCT Pub. No.: WO2016/152995
PCT Pub. Date: Sep. 29, 2016

(65) Prior Publication Data

US 2017/0204348 A1 Jul. 20, 2017

(30) Foreign Application Priority Data

Mar. 24, 2015 (JP) ..... 2015-061746

(51) Int. Cl.

| | |
|---|---|
| ***C10M 169/04*** | (2006.01) |
| ***C10M 159/20*** | (2006.01) |
| ***C10M 165/00*** | (2006.01) |
| ***C10N 10/02*** | (2006.01) |
| ***C10N 10/04*** | (2006.01) |
| ***C10N 30/02*** | (2006.01) |
| ***C10N 30/04*** | (2006.01) |
| ***C10N 30/06*** | (2006.01) |
| ***C10N 30/08*** | (2006.01) |
| ***C10N 30/10*** | (2006.01) |
| ***C10N 30/18*** | (2006.01) |
| ***C10N 30/00*** | (2006.01) |
| ***C10N 40/25*** | (2006.01) |
| ***C10N 60/14*** | (2006.01) |

(52) U.S. Cl.

CPC ..... *C10M 169/04* (2013.01); *C10M 159/20* (2013.01); *C10M 165/00* (2013.01); *C10M 2203/1025* (2013.01); *C10M 2205/0285* (2013.01); *C10M 2207/026* (2013.01); *C10M 2207/262* (2013.01); *C10M 2209/084* (2013.01); *C10M 2215/064* (2013.01); *C10M 2215/28* (2013.01); *C10M 2219/046* (2013.01); *C10M 2223/045* (2013.01); *C10N 2010/02* (2013.01); *C10N 2010/04* (2013.01); *C10N 2030/02* (2013.01); *C10N 2030/04* (2013.01); *C10N 2030/06* (2013.01); *C10N 2030/08* (2013.01); *C10N 2030/10* (2013.01); *C10N 2030/18* (2013.01); *C10N 2030/40* (2020.05); *C10N 2030/45* (2020.05); *C10N 2030/52* (2020.05); *C10N 2030/68* (2020.05); *C10N 2040/255* (2020.05); *C10N 2060/14* (2013.01)

(58) Field of Classification Search

CPC ..... C10M 169/04; C10M 2215/086; C10M 2215/28; C10M 159/20; C10M 165/00; C10M 2203/1025; C10M 2205/0285; C10M 2207/026; C10M 2207/262; C10M 2209/084; C10M 2215/064; C10M 2219/046; C10M 2223/045; C10N 2210/02; C10N 2010/04; C10N 2030/02; C10N 2030/04; C10N 2030/06; C10N 2030/08; C10N 2030/10; C10N 2030/18; C10N 2030/40; C10N 2030/45; C10N 2030/52; C10N 2030/68; C10N 2040/255; C10N 2060/14

See application file for complete search history.

(56) References Cited

U.S. PATENT DOCUMENTS

| | | | | |
|---|---|---|---|---|
| 6,114,288 | A * | 9/2000 | Fujitsu | C10M 163/00 508/371 |
| 7,820,599 | B2 * | 10/2010 | Kasai | C10M 163/00 508/192 |
| 2003/0148895 | A1 * | 8/2003 | Robson | C10M 141/12 508/155 |
| 2005/0043191 | A1 * | 2/2005 | Farng | C10M 161/00 508/185 |
| 2006/0116299 | A1 * | 6/2006 | Arrowsmith | C10M 163/00 508/443 |

(Continued)

FOREIGN PATENT DOCUMENTS

| | | | |
|---|---|---|---|
| CN | 1453348 | A | 11/2003 |
| EP | 0 317 354 | A1 | 5/1989 |

(Continued)

OTHER PUBLICATIONS

Office Action dated Feb. 7, 2017 in Japanese Patent Application No. 2016-547968.

(Continued)

*Primary Examiner* — James C Goloboy
(74) *Attorney, Agent, or Firm* — Oblon, McClelland, Maier & Neustadt, L.L.P.

(57) ABSTRACT

Provided is a lubricating oil composition having excellent detergency and LSPI preventing performance, and specifically a lubricating oil composition including a base oil, a calcium detergent, and a magnesium detergent and/or a sodium detergent, wherein the content of the calcium detergent as converted into a calcium atom and a mass ratio of a magnesium atom (Mg) contained in the magnesium detergent and/or a sodium atom (Na) contained in the sodium detergent to a calcium atom (Ca) [(Mg and/or Na)/Ca] fall within the specific ranges.

12 Claims, No Drawings

(56) References Cited

U.S. PATENT DOCUMENTS

| | | | | |
|---|---|---|---|---|
| 2009/0082233 | A1 | 3/2009 | Kasai | |
| 2011/0207642 | A1 | 8/2011 | Strickland et al. | |
| 2011/0245120 | A1* | 10/2011 | Bertram | C10M 163/00 508/287 |
| 2013/0310289 | A1* | 11/2013 | Umehara | C10M 135/18 508/363 |
| 2014/0005086 | A1 | 1/2014 | Huang et al. | |
| 2015/0307802 | A1 | 10/2015 | Ritchie et al. | |
| 2015/0322368 | A1* | 11/2015 | Patel | C10M 163/00 508/192 |
| 2015/0322369 | A1* | 11/2015 | Patel | C10M 163/00 508/162 |
| 2016/0230116 | A1* | 8/2016 | Mosier | C10M 163/00 |

FOREIGN PATENT DOCUMENTS

| | | | |
|---|---|---|---|
| EP | 3 101 095 | A1 | 12/2016 |
| EP | 3 275 980 | A1 | 1/2018 |
| JP | 1-201399 | A | 8/1989 |
| JP | 11-315297 | A | 11/1999 |
| JP | 2005-162968 | A | 6/2005 |
| JP | 2008-120908 | A | 5/2008 |
| JP | 2013-544948 | A | 12/2013 |
| JP | 2014-152301 | A | 8/2014 |
| JP | 2015-163673 | A | 9/2015 |
| WO | 2015/042337 | A1 | 3/2015 |
| WO | 2015/042340 | A1 | 3/2015 |
| WO | 2015/042341 | A1 | 3/2015 |
| WO | WO 2016/148708 | A1 | 9/2016 |

OTHER PUBLICATIONS

International Search Report dated Apr. 19, 2016 in PCT/JP2016/059455 filed Mar. 24, 2016.

Extended European Search Report dated Jun. 5, 2019 in European Patent Application No. 19155477.3.

Extended European Search Report dated Dec. 13, 2018 in corresponding European Patent Application No. 16768898.5, 10 pages.

Office Action dated Oct. 24, 2019, in Indian Patent Application No. 201747032928, filed Sep. 18, 2017.

Office Action in U.S. Appl. No. 16/271,351, dated Mar. 23, 2020.

Office Action dated Nov. 12, 2019, in Chinese Patent Application No. 201680001834.1, filed Mar. 24, 2016, (with English Translation).

* cited by examiner

LUBRICANT COMPOSITION FOR GASOLINE ENGINE AND METHOD FOR PRODUCING SAME

CROSS-REFERENCE TO RELATED APPLICATIONS

This application is a National Stage of PCT/JP2016/059455, which was filed on Mar. 24, 2016. This application is based upon and claims the benefit of priority to Japanese Application No. 2015-061746, which was filed on Mar. 24, 2015.

TECHNICAL FIELD

The present invention relates to a lubricating oil composition for a gasoline engine and a method for producing the same.

BACKGROUND ART

At present, the environmental regulations on a global scale are becoming strict more and more, and the situation surrounding automobiles is getting strict from the sides of fuel economy regulations, exhaust gas regulations, and so on. In this background, there are environmental issues regarding global warming, etc. and resource protection in view of a concern regarding depletion of oil resources, and fuel consumption reduction on automobiles is an urgent need. In order to improve the fuel consumption reduction on automobiles, the development of a gasoline engine and the market expansion are advanced. Especially, in comparison with the conventional engines, a gasoline engine mounted with a direct injection supercharger makes it possible to achieve miniaturization (weight saving of an automobile) at the same power. Thus, a large contribution to improvements in fuel consumption performance is expected.

There has hitherto been made an attempt of adoption of mainly a calcium detergent as a metal detergent for a lubricating oil composition that is used for gasoline engines, diesel engines, and so on, thereby improving detergency (see, for example, PTL 1).

CITATION LIST

Patent Literature

PTL 1: JP 2008-120908 A

SUMMARY OF INVENTION

Technical Problem

Now, in recent years, in advancing the development of gasoline engines, particularly gasoline engines mounted with a direct injection supercharger, a phenomenon called low speed pre-ignition (hereinafter also referred to as "LSPI") at the time of low-speed operation becomes problematic. This LSPI phenomenon is a phenomenon in which ignition is caused earlier than a set-up ignition timing in a low-speed operation state, and there is a case where abnormal combustion (detonation) attributable to the ignition occurs within an engine cylinder.

In order to improve the detergency, a lubricating oil composition adopts mainly a calcium detergent as a metal-based detergent as in the composition described in PTL 1. But, in a lubricating oil composition in which a blending amount of the calcium detergent is increased in order to more enhance the detergency, it became clear that when ignited in a high-pressure atmosphere, the amount of heat generation is large. Since the ignition of the lubricating oil composition which has invaded into an engine cylinder becomes a cause of the LSPI, from the viewpoint of prevention of the generation of LSPI, it is necessary that the blending amount of the calcium detergent is reduced as far as possible.

In the light of the above, nevertheless the detergency and the LSPI preventing performance are a contrary performance to each other, a lubricating oil composition in which the detergency and the LSPI preventing performance are improved in a well balance, and moreover, a lubricating oil composition capable of being also applied to a gasoline engine mounted with a direct injection supercharger were desired.

In view of the aforementioned circumstances, the present invention has been made, and an object thereof is to provide a lubricating oil composition having excellent detergency and LSPI preventing performance.

Solution to Problem

The present inventor made extensive and intensive investigations. As a result, it has been found that the aforementioned problem can be solved by the following invention. Specifically, the present invention provides a lubricating oil composition having the following constitution and a method for producing the same.

[1] A lubricating oil composition for gasoline engine, including a base oil, a calcium detergent, and a magnesium detergent and/or a sodium detergent, wherein the content of the calcium detergent as converted into a calcium atom is less than 2,000 ppm by mass on a basis of the whole amount of the composition, and a mass ratio of a magnesium atom (Mg) contained in the magnesium detergent and/or a sodium atom (Na) contained in the sodium detergent to a calcium atom (Ca) [(Mg and/or Na)/Ca] is 0.05 to 1.50.

[2] The lubricating oil composition for gasoline engine as set forth above in [1], further including a poly(meth)acrylate.

[3] The lubricating oil composition for gasoline engine as set forth above in [1] or [2], further including a succinimide and/or a boron-containing succinimide.

[4] A method for producing a lubricating oil composition for gasoline engine, including blending a base oil with a calcium detergent and a magnesium detergent and/or a sodium detergent, such that the content of the calcium detergent as converted into a calcium atom is less than 2,000 ppm by mass on a basis of the whole amount of the composition, and a mass ratio of a magnesium atom (Mg) contained in the magnesium detergent and/or a sodium atom (Na) contained in the sodium detergent to a calcium atom (Ca) [(Mg and/or Na)/Ca] is 0.05 to 1.50.

Advantageous Effects of Invention

The lubricating oil composition of the present invention has excellent detergency and LSPI preventing performance and has a performance that may conform to a gasoline engine, especially a gasoline engine mounted with a direct injection supercharger.

Embodiments of Invention

The lubricating oil composition of the present invention includes a base oil, a calcium detergent, and a magnesium detergent and/or a sodium detergent. Specifically, the lubricating oil composition of the present invention includes a base oil, a calcium detergent, and a magnesium detergent and/or a sodium detergent, wherein the content of the calcium detergent as converted into a calcium atom is less than 2,000 ppm by mass on a basis of the whole amount of the composition, and a mass ratio of a magnesium atom (Mg) contained in the magnesium detergent and/or a sodium atom (Na) contained in the sodium detergent to a calcium atom (Ca) [(Mg and/or Na)/Ca] is 0.05 to 1.50.

(Base Oil)

The base oil that is contained in the lubricating oil composition of the present invention may be either a mineral oil or a synthetic oil, and a mixed oil of a mineral oil and a synthetic oil may also be used.

Examples of the mineral oil include atmospheric residues obtained by subjecting a crude oil, such as a paraffin base mineral oil, an intermediate base mineral oil, a naphthenic base oil, etc., to atmospheric distillation; distillates obtained by subjecting such an atmospheric residue to distillation under reduced pressure; mineral oils and waxes resulting from subjecting the distillate to one or more treatments of solvent deasphalting, solvent extraction, hydro-cracking, solvent dewaxing, catalytic dewaxing, hydrorefining, and the like.

Examples of the synthetic oil include a poly-α-olefin (PAO), such as polybutene and an α-olefin homopolymer or copolymer (for example, a homopolymer or copolymer of an α-olefin having 8 to 14 carbon atoms, such as an ethylene-α-olefin copolymer, etc.), etc.; various esters, such as a polyol ester, a dibasic acid ester, a phosphate ester, etc.; various ethers, such as a polyphenyl ether, etc.; a polyglycol; an alkylbenzene; an alkylnaphthalene; a synthetic oil obtained by isomerizing a wax (GTL wax) produced by a Fischer-Tropsch process or the like; and the like.

Of those, from the viewpoint of improving the detergency and the LSPI preventing performance of the lubricating oil composition, at least one selected from a mineral oil and a synthetic oil which are classified into Groups 3 to 5 of the base stock categories of the API (American Petroleum Institute) is preferred.

A kinematic viscosity at 100° C. of the base oil is preferably 2 to 30 $mm^2/s$, and more preferably 2 to 15 $mm^2/s$. When the kinematic viscosity at 100° C. of the base oil is 2 $mm^2/s$ or more, an evaporation loss is small, whereas when it is 30 $mm^2/s$ or less, a power loss attributable to viscous resistance is not so large, and hence, a fuel consumption improving effect is obtained.

From the viewpoint of not only suppressing a change in viscosity attributable to a change in temperature but also improving the fuel consumption reducing properties, a viscosity index of the base oil is preferably 120 or more. In the case of using a mixed oil composed of a combination of two or more mineral oils and/or synthetic oils as the base oil, it is preferred that the kinematic viscosity and the viscosity index of the mixed oil fall within the aforementioned ranges.

The content of the base oil is preferably 55 mass % or more, more preferably 60 mass % or more, still more preferably 65 mass % or more, and especially preferably 70 mass % or more, and preferably 99 mass % or less, and more preferably 95 mass % or less relative to the whole amount of the lubricating oil composition.

(Calcium Detergent)

The lubricating oil composition of the present invention includes a calcium detergent.

Examples of the calcium detergent include calcium salts of a sulfonate, a phenate, and a salicylate, and these can be used alone or in combination of plural kinds thereof. From the viewpoint of improving the detergency and the fuel consumption reducing properties, a calcium salt of a salicylate (calcium salicylate) is preferred.

Such a calcium detergent may be any of a neutral salt, a basic salt, and an overbased salt, and from the viewpoint of detergency, the calcium detergent is preferably a basic salt or an overbased salt. A total base number thereof is preferably 10 to 500 mgKOH/g, more preferably 150 to 500 mgKOH/g, still more preferably 150 to 450 mgKOH/g, and especially preferably 180 to 300 mgKOH/g. Here, the total base number means one as measured in conformity with the perchloric acid method prescribed in JIS K2501.

The content of the calcium detergent as converted into a calcium atom is less than 2,000 ppm by mass on a basis of the whole amount of the composition. When the content of the calcium detergent is 2,000 ppm by mass or more, the LSPI preventing performance is not obtained. From the viewpoints of detergency and LSPI preventing performance, the content of the calcium detergent is preferably 800 ppm by mass or more, more preferably 800 to 1,800 ppm by mass, and still more preferably 800 to 1,500 ppm by mass. In order to obtain more excellent detergency, it is necessary to use a large amount (for example, 2,000 ppm by mass or more) of the calcium detergent; however, meanwhile, the LSPI is liable to be generated. In accordance with the present invention, even if the content of the calcium detergent is a small amount as less than 2,000 ppm by mass, furthermore 1,800 ppm by mass or less, and moreover 1,500 ppm by mass or less, when using in a specified ratio in combination with other detergents as described later, it has been made to possible to obtain an excellent LSPI preventing performance while ensuring the excellent detergency.

The content as converted into a calcium atom in the lubricating oil composition is a value as measured in conformity with JIS-5S-38-92. In addition, the content of each of a magnesium atom, a sodium atom, a boron atom, a molybdenum atom, and a phosphorus atom as described later is also a value as measured in conformity with JIS-5S-38-92. In addition, the content as converted into a nitrogen atom means a value as measured in conformity with JIS K2609.

(Magnesium Detergent/Sodium Detergent)

The lubricating oil composition of the present invention includes a magnesium detergent and/or a sodium detergent.

Examples of the magnesium detergent and the sodium detergent include magnesium salts and sodium salts of a sulfonate, a phenate, and a salicylate, and these can be used alone or in combination of plural kinds thereof. From the viewpoint of detergency, a magnesium salt of a sulfonate (magnesium sulfonate) and a sodium salt (sodium sulfonate) are preferred.

Though such a detergent may be any of a neutral salt, a basic salt, and an overbased salt, and from the viewpoint of detergency, a basic salt or an overbased salt is preferred. A total base number thereof is preferably 150 to 650 mgKOH/g, more preferably 150 to 500 mgKOH/g, and still more preferably 200 to 500 mgKOH/g. Here, the total base number means one as measured in conformity with the perchloric acid method prescribed in JIS K2501.

The content of the magnesium detergent and/or the sodium detergent as converted into a magnesium atom and/or a sodium atom is preferably 100 ppm by mass or more on a basis of the whole amount of the composition. When the content of the magnesium detergent and/or the sodium detergent as converted into a magnesium atom and/or a sodium atom is 100 ppm by mass or more, excellent detergency and LSPI preventing performance are obtained. From the viewpoint of obtaining excellent detergency and LSPI preventing performance, the content of the magnesium detergent and/or the sodium detergent as converted into a magnesium atom and/or a sodium atom is preferably 100 to 1,500 ppm by mass, and more preferably 300 to 1,000 ppm by mass. In the case of using the magnesium detergent and the sodium detergent in combination, the aforementioned content is applied to the total content of these detergents.

A mass ratio of a magnesium atom (Mg) contained in the magnesium detergent and/or a sodium atom (Na) contained in the sodium detergent to a calcium atom (Ca) [(Mg and/or Na)/Ca] is 0.05 to 1.50. When this mass ratio is less than 0.05, the excellent LSPU preventing performance or detergency is not obtained. On the other hand, when it is more than 1.50, not only the excellent detergency is not obtained, but also there is a case where an acicular crystal derived from the magnesium detergent or the like is generated depending upon conditions for using the lubricating oil composition, resulting in gelation. From the viewpoint of obtaining excellent detergency and LSPI preventing performance, the mass ratio is preferably 0.10 to 1.00, and more preferably 0.20 to 0.75.

(Poly(Meth)Acrylate)

From the viewpoint of fuel consumption reduction, it is preferred that the lubricating oil composition of the present invention further includes a poly(meth)acrylate. The poly (meth)acrylate functions as a viscosity index improver or a pour-point depressant, and when using this, the viscosity characteristic of the lubricating oil composition is improved, thereby enabling the fuel consumption reducing properties to be improved.

The poly(meth)acrylate may be any of a dispersion type and a non-dispersion type, and one constituted of an alkyl (meth)acrylate having an alkyl group in a molecule thereof is preferred. As the alkyl group in the alkyl (meth)acrylate, a straight-chain alkyl group having 1 to 18 carbon atoms or a branched-chain alkyl group having 3 to 18 carbon atoms is preferably exemplified.

Examples of such a monomer include methyl (meth) acrylate, ethyl (meth)acrylate, propyl (meth)acrylate, butyl (meth)acrylate, pentyl (meth)acrylate, hexyl (meth)acrylate, heptyl (meth)acrylate, octyl (meth)acrylate, nonyl (meth) acrylate, decyl (meth)acrylate, and the like, and two or more of these monomers may also be used as a copolymer. The alkyl group of such a monomer may be either a straight-chain alkyl group or a branched-chain alkyl group.

A weight average molecular weight (Mw) of the poly (meth)acrylate is preferably 10,000 to 1,000,000, more preferably 30,000 to 600,000, still more preferably 320,000 to 600,000, and especially preferably 400,000 to 550,000. A number average molecular weight (Mn) of the poly(meth) acrylate is preferably 10,000 to 1,000,000, and more preferably 30,000 to 500,000. In addition, a molecular weight distribution (Mw/Mn) is preferably 6 or less, more preferably 5 or less, and still more preferably 3.5 or less. When the molecular weight of the poly(meth)acrylate falls within the aforementioned range, excellent fuel consumption reducing properties are obtained. Here, the weight average molecular weight and the number average molecular weight are each a value as measured by GPC and obtained using polystyrene as a calibration curve and in detail, measured under the following conditions.

Column: Two TSK gel GMH6 columns
Measurement temperature: 40° C.
Sample solution: 0.5 mass % THF solution
Detector: Refractive index detector
Standard: Polystyrene The content of the poly(meth)acrylate on a basis of the whole amount of the composition has only to be properly set according to a desired HTHS viscosity and so on, and it is preferably 0.01 to 10.00 mass %, more preferably 0.05 to 5.00 mass %, and still more preferably 0.05 to 2.00 mass %. When the foregoing content falls within the aforementioned range, excellent detergency is obtained together with fuel consumption reducing properties.

Here, the content of the poly(meth)acrylate means the content of only the resin component composed of the poly(meth)acrylate and is, for example, the content on a basis of the solid component, in which the mass of a diluent oil and so on contained together with the poly(meth)acrylate is not included.

It is preferred that the lubricating oil composition of the present invention contains, as the viscosity index improver, a polymer having a structure having a large number of trigeminal branch points from which a linear side chain comes out (the polymer will be hereinafter referred to as "comb-shaped polymer"). Examples of such a comb-shaped polymer include polymers having at least a constituent unit derived from a macromonomer having a polymerizable functional group, such as a (meth)acryloyl group, an ethenyl group, a vinyl ether group, an allyl group, etc. Here, the foregoing constituent unit is corresponding to the "linear side chain".

More specifically, copolymers having a side chain including a constituent unit derived from a macromonomer having the aforementioned polymerizable functional group on a main chain including a constituent unit derived from a vinyl monomer of every kind, such as an alkyl (meth)acrylate, a nitrogen atom-containing monomer, a halogen element-containing monomer, a hydroxyl group-containing monomer, an aliphatic hydrocarbon-based monomer, an alicyclic hydrocarbon-based monomer, an aromatic hydrocarbon-based monomer, etc., are preferably exemplified.

A number average molecular weight (Mn) of the macromonomer is preferably 200 or more, more preferably 300 or more, and still more preferably 400 or more, and preferably 100,000 or less, more preferably 50,000 or less, and still more preferably 10,000 or less.

From the viewpoint of improving the fuel consumption reducing properties, a weight average molecular weight (Mw) of the comb-shaped polymer is preferably 1,000 to 1,000,000, more preferably 5,000 to 800,000, and still more preferably 50,000 to 700,000. A molecular weight distribution (Mw/Mn) is preferably 6 or less, more preferably 5.6 or less, and still more preferably 5 or less; and though a lower limit value thereof is not particularly limited, it is typically 1.01 or more, preferably 1.05 or more, more preferably 1.10 or more, and still more preferably 1.50 or more.

From the viewpoint of improving the fuel consumption reducing properties, the content of the comb-shaped polymer is preferably 0.1 to 20.0 mass %, more preferably 0.5 to 10.0 mass %, and still more preferably 1.0 to 8.0 mass % on a basis of the whole amount of the composition. Here, the content of the comb-shaped polymer means the content of only the resin component composed of the comb-shaped polymer and is, for example, the content on a basis of the solid component, in which the mass of a diluent oil and so on contained together with the comb-shaped polymer is not included.

The lubricating oil composition of the present invention may also include other viscosity index improvers than the aforementioned poly(meth)acrylate and comb-shaped polymer, for example, an olefin-based copolymer (for example, an ethylene-propylene copolymer, etc.), a dispersion type olefin-based copolymer, or a styrene-based copolymer (for example, a styrene-diene copolymer, a styrene-isoprene copolymer, etc.).

From the viewpoint of improving the detergency of the lubricating oil composition, in the viscosity index improver that is used in the present invention, the content of the poly(meth)acrylate and/or the comb-shaped polymer is preferably 70 to 100 mass %, more preferably 80 to 100 mass %, and still more preferably 90 to 100 mass % relative to the whole amount (100 mass %) of the solid component in the viscosity index improver.

(Succinimide and/or Boron-Containing Succinimide)

From the viewpoint of detergency, it is preferred that the lubricating oil composition of the present invention includes a succinimide and/or a boron-containing succinimide as a dispersant. As the succinimide, alkenyl succinimides or alkyl succinimides having an alkenyl group or an alkyl group in a molecule thereof are preferably exemplified. Examples thereof include a mono-type represented by the following general formula (1) and a bis-type represented by the following general formula (2).

(1)

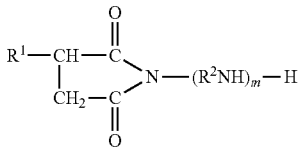

(2)

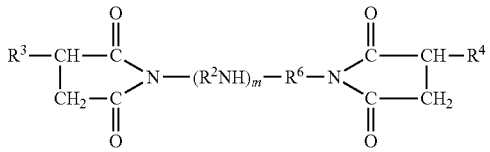

In the general formulae (1) and (2), $R^1$, $R^3$, and $R^4$ each represent an alkenyl group or an alkyl group each having a number average molecular weight of 500 to 4,000, and $R^3$ and $R^4$ may be the same as or different from each other. The number average molecular weight of $R^1$, $R^3$, and $R^4$ is preferably 1,000 to 4,000.

When the number average molecular weight of $R^1$, $R^3$, and $R^4$ is 500 or more, the solubility in the base oil is favorable, whereas when it is 4,000 or less, favorable dispersibility is obtained, and excellent detergency is obtained.

$R^2$, $R^5$, and $R^6$ each represent an alkylene group having 2 to 5 carbon atoms, and $R^5$ and $R^6$ may be the same as or different from each other.

m is an integer of 1 to 10, preferably an integer of 2 to 5, and more preferably 3 or 4. When m is 1 or more, the dispersibility is favorable, whereas when it is 10 or less, the solubility in the base oil is also favorable, and excellent detergency is obtained.

n is an integer of 0 to 10, preferably an integer of 1 to 4, and more preferably 2 or 3. When n falls within the aforementioned range, such is preferred from the standpoints of dispersibility and solubility in the base oil, and excellent detergency is obtained.

As the alkenyl group that may be adopted in $R^1$, $R^3$, and $R^4$, a polybutenyl group, a polyisobutenyl group, and an ethylene-propylene copolymer can be exemplified, and as the alkyl group, those obtained through hydrogenation thereof are exemplified. As the polybutenyl group, those obtained through polymerization of a mixture of 1-butene and isobutene or high-purity isobutene are preferably used. Above all, the alkenyl group is preferably a polybutenyl group or an isobutenyl group, and as the alkyl group, those obtained through hydrogenation of a polybutenyl group or an isobutenyl group are exemplified. In the present invention, from the viewpoint of detergency, an alkenyl group is preferred, namely an alkenyl succinimide or a boron-containing alkenyl succinimide is preferred.

Examples of the alkylene group that may be adopted in $R^2$, $R^5$, and $R^6$ include a methylene group, an ethylene group, an ethylidene group, a trimethylene group, a propylene group, an isopropylene group, a tetramethylene group, a butylene group, an isobutylene group, a pentylene group, a hexamethylene group, a hexylene group, and the like.

The succinimide can be typically produced by allowing an alkenylsuccinic anhydride that is obtained through a reaction between a polyolefin and maleic anhydride, or an alkylsuccinic anhydride that is obtained through hydrogenation thereof, to react with a polyamine. In addition, a mono-type succinimide compound and a bis-type succinimide compound can be produced by varying a reaction ratio between the alkenylsuccinic anhydride or alkylsuccinic anhydride and the polyamine.

As an olefin monomer that forms the polyolefin, an α-olefin having 2 to 8 carbon atoms can be used alone or as a mixture of two or more thereof, and a mixture of isobutene and 1-butene is preferred.

Examples of the polyamine include single diamines, such as ethylenediamine, propylenediamine, butylenediamine, pentylenediamine, etc.; polyalkylene polyamines, such as diethylene triamine, triethylene tetramine, tetraethylene pentamine, pentaethylene hexamine, di(methylethylene)triamine, dibutylene triamine, tributylene tetramine, pentapentylene hexamie, etc.; piperazine derivatives, such as aminoethylpiperazine, etc.; and the like.

The nitrogen content in the lubricating oil composition of the present invention is preferably less than 0.16 mass %. When the nitrogen content in the composition is less than 0.16 mass %, the detergency and the fuel consumption reducing properties can be improved in a well balance. From the same viewpoint, the nitrogen content is preferably 0.01 mass % or more and less than 0.16 mass %, preferably 0.01 to 0.14 mass %, more preferably 0.03 to 0.13 mass %, still more preferably 0.04 to 0.12 mass %, and especially preferably 0.06 to 0.12 mass %. Here, the nitrogen content is a content mainly caused due to the succinimide and/or the boron-containing succinimide, and the content of the succinimide and/or the boron-containing succinimide as converted into a nitrogen atom is preferably 0.02 to 0.08 mass %, more preferably 0.03 to 0.08 mass %, and still more preferably 0.03 mass % or more and less than 0.07 mass % on a basis of the whole amount of the composition.

The boron-containing succinimide can be, for example, produced by allowing the aforementioned alkenylsuccinic anhydride or alkylsuccinic anhydride that is obtained through a reaction between a polyolefin and maleic anhydride to react with the aforementioned polyamine and a boron compound.

Examples of the boron compound include boron oxide, a boron halide, boric acid, boric anhydride, a boric acid ester, an ammonium salt of boric acid, and the like.

From the viewpoint of improving the detergency and the fuel consumption reducing properties in a well balance, the content of the boron-containing succinimide as converted into a boron atom is preferably 600 ppm by mass or less, more preferably 10 to 600 ppm by mass, still more preferably 30 to 500 ppm by mass, yet still more preferably 120 to 400 ppm by mass, and especially preferably 220 to 400 ppm by mass on a basis of the whole amount of the composition.

In the lubricating oil composition of the present invention, a modified polybutenyl succinimide obtained through a reaction between the aforementioned succinimide and an alcohol, an aldehyde, a ketone, an alkylphenol, a cyclic carbonate, an epoxy compound, an organic acid, or the like can be used.

From the viewpoints of detergency and fuel consumption reducing properties, it is preferred that the lubricating oil composition of the present invention includes a boron-containing polybutenyl succinimide, and it is more preferred that the lubricating oil composition of the present invention includes a boron-containing polybutenyl succinimide and a boron-free polybutenyl succinic acid bisimide.

(Anti-Wear Agent)

From the viewpoint of improving the fuel consumption reducing properties and anti-wear characteristic, it is preferred that the lubricating oil composition of the present invention includes an anti-wear agent or an extreme pressure agent. Examples of the anti-wear agent or extreme pressure agent include organic zinc compounds, such as zinc phosphate, a zinc dialkyldithiophosphate (ZnDTP), zinc dithiocarbamate (ZnDTC), etc.; sulfur-containing compounds, such as disulfides, sulfurized olefins, sulfurized oils and fats, sulfurized esters, thiocarbonates, thiocarbamates, polysulfides, etc.; phosphorus-containing compounds, such as phosphite esters, phosphate esters, phosphonate esters, and amine salts or metal salts thereof, etc.; and sulfur- and phosphorus-containing anti-wear agents, such as thiophosphite esters, thiophosphate esters, thiophosphonate esters, and amine salts or metal salts thereof, etc. These anti-wear agents can be used alone or in combination of any two or more thereof. Of those, a zinc dialkyldithiophosphate (ZnDTP) is preferred.

Examples of the zinc dialkyldithiophosphate (ZnDTP) include a compound represented by the following general formula (3).

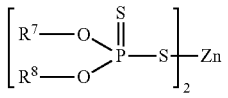

(3)

In the general formula (3), $R^7$ and $R^8$ each independently represent a primary or secondary alkyl group having 3 to 22 carbon atoms or an alkylaryl group substituted with an alkyl group having 3 to 18 carbon atoms.

Here, examples of the primary or secondary alkyl group having 3 to 22 carbon atoms include a primary or secondary propyl group, a primary or secondary butyl group, a primary or secondary pentyl group, a primary or secondary hexyl group, a primary or secondary heptyl group, a primary or secondary octyl group, a primary or secondary nonyl group, a primary or secondary decyl group, a primary or secondary dodecyl group, a primary or secondary tetradecyl group, a primary or secondary hexadecyl group, a primary or secondary octadecyl group, a primary or secondary eicosyl group, and the like. Examples of the alkylaryl group substituted with an alkyl group having 3 to 18 carbon atoms include a propylphenyl group, a pentylphenyl group, an octylphenyl group, a nonylphenyl group, a dodecylphenyl group, and the like.

In the case of using a zinc dialkyldithiophosphate (ZnDTP), the compound represented by the general formula (3) can be used alone or in combination of plural kinds thereof; however, it is preferred to use at least a zinc primary dialkyldithiophosphate (primary alkyl ZnDTP) having a primary alkyl group, and it is more preferred to use a primary alkyl ZnDTP alone. In the case of using a combination of a primary alkyl ZnDTP and a zinc secondary dialkyldithiophosphate (secondary alkyl ZnDTP) having a secondary alkyl group, a mass blending ratio of the primary alkyl ZnDTP to the secondary alkyl ZnDTP is preferably 1/3 to 1/15, more preferably 1/4 to 1/10, and still more preferably 1/6 to 1/10.

In the case of using a zinc dialkyldithiophosphate (ZnDTP) as the anti-wear agent, the content of ZnDTP as converted into a phosphorus atom is preferably 100 to 2,000 ppm by mass, more preferably 300 to 1,500 ppm by mass, still more preferably 500 to 1,000 ppm by mass, and especially preferably 600 to 840 ppm by mass on a basis of the whole amount of the composition.

(Antioxidant)

It is preferred that the lubricating oil composition of the present invention includes an antioxidant. Examples of the antioxidant include an amine-based antioxidant, a phenol-based antioxidant, a molybdenum-based antioxidant, a sulfur-based antioxidant, a phosphorus-based antioxidant, and the like.

Examples of the amine-based antioxidant include diphenylamine-based antioxidants, such as diphenylamine, an alkylated diphenylamine having an alkyl group having 3 to 20 carbon atoms, etc.; naphthylamine-based antioxidants, such as α-naphthylamine, a $C_3$-$C_{20}$-alkyl-substituted phenyl-α-naphthylamine, etc.; and the like.

Examples of the phenol-based antioxidant include monophenol-based antioxidants, such as 2,6-di-tert-butyl-4-methylphenol, 2,6-di-tert-butyl-4-ethylphenol, octadecyl-3-(3,5-di-tert-butyl-4-hydroxyphenyl)propionate, etc.; diphenol-based antioxidants, such as 4,4'-methylenebis (2,6-di-tert-butylphenol), 2,2'-methylenebis(4-ethyl-6-tert-butylphenol), etc.; hindered phenol-based antioxidants; and the like.

Examples of the molybdenum-based antioxidant include a molybdenum amine complex resulting from a reaction of molybdenum trioxide and/or molybdic acid and an amine compound; and the like.

Examples of the sulfur-based antioxidant include dilauryl-3,3'-thiodipropionate and the like.

Examples of the phosphorus-based antioxidant include a phosphite and the like.

Though these antioxidants may be used alone or in combination of plural kinds thereof, in general, the use of a combination of plural kinds thereof is preferred.

The content of the antioxidant is preferably 0.01 to 3 mass %, and more preferably 0.1 to 2 mass % on a basis of the whole amount of the composition. In the case of using an amine-based antioxidant as the antioxidant, its content as converted into a nitrogen atom is preferably 50 to 1,500 ppm by mass, more preferably 100 to 1,000 ppm by mass, still more preferably 150 to 800 ppm by mass, and especially preferably 200 to 600 ppm by mass on a basis of the whole amount of the composition.

(Pour-Point Depressant)

It is preferred that the lubricating oil composition of the present invention includes a pour-point depressant. Examples of the pour-point depressant include an ethylene-vinyl acetate copolymer, a condensate of a chlorinated paraffin and naphthalene, a condensate of a chlorinated paraffin and phenol, a polymethacrylate, a polyalkylstyrene, the aforementioned poly(meth)acrylate, and the like.

A weight average molecular weight (Mw) of the pour-point depressant is preferably 20,000 to 100,000, more preferably 30,000 to 80,000, and still more preferably 40,000 to 60,000. A molecular weight distribution (Mw/Mn) is preferably 5 or less, more preferably 3 or less, and still more preferably 2 or less.

The content of the pour-point depressant may be properly determined according to a desired MRV viscosity or the like, and it is preferably 0.01 to 5 mass %, and more preferably 0.02 to 2 mass %.

(Friction Modifier)

From the viewpoint of improving the fuel consumption reducing properties and anti-wear characteristic, it is preferred that the lubricating oil composition of the present invention includes a friction modifier. As the friction modifier, those which are generally used as a friction modifier of a lubricating oil composition can be used without limitations. Examples thereof include ashless friction modifiers having at least one alkyl group or alkenyl group having 6 to 30 carbon atoms, especially a straight-chain alkyl group or straight-chain alkenyl group having 6 to 30 carbon atoms in a molecule thereof, such as an aliphatic amine, a fatty acid ester, a fatty acid amide, a fatty acid, an aliphatic alcohol, an aliphatic ether, etc.; molybdenum friction modifiers, such as molybdenum dithiocarbamate (MoDTC), molybdenum dithiophosphate (MoDTP), an amine salt of molybdic acid, etc.; and the like, and these friction modifiers can be used alone or in combination of plural kinds thereof. Of those, molybdenum friction modifiers are preferred.

In the case of using an ashless friction modifier, its content is preferably 0.01 to 3 mass %, and more preferably 0.1 to 2 mass % on a basis of the whole amount of the composition. In the case of using the molybdenum friction modifier, its content as converted into a molybdenum atom is preferably 0.01 to 15 mass %, more preferably 0.012 to 0.1 mass %, still more preferably 0.015 to 0.08 mass %, yet still more preferably 0.02 to 0.08 mass %, and especially preferably more than 0.04 mass % and 0.07 mass % or less on a basis of the whole amount of the composition. When the content falls within the aforementioned range, excellent fuel consumption reducing properties and anti-wear characteristic are obtained, and a lowering of detergency can be suppressed.

(General-Purpose Additive)

The lubricating oil composition of the present invention may further contain a general-purpose additive, if desired within the range where the effects of the present invention are not impaired. Examples of the general-purpose additive include a rust preventive, a metal deactivator, a defoaming agent, an extreme pressure agent, and the like.

Examples of the rust preventive include a petroleum sulfonate, an alkylbenzene sulfonate, dinonylnaphthalene sulfonate, an alkenylsuccinic ester, a polyhydric alcohol ester, and the like.

Examples of the metal deactivator include a benzotriazole-based compound, a tolyltriazole-based compound, a thiadiazole-based compound, an imidazole-based compound, a pyrimidine-based compound, and the like.

Examples of the defoaming agent include silicone oil, fluorosilicone oil, a fluoroalkyl ether, and the like.

Examples of the extreme pressure agent include sulfur-based extreme pressure agents, such as sulfides, sulfoxides, sulfones, thiophosphinates, etc.; halogen-based extreme pressure agents, such as a chlorinated hydrocarbon, etc.; organic metal-based extreme pressure agents; and the like.

The content of such a general-purpose additive can be properly regulated within the range where the effects of the present invention are not impaired, and it is typically 0.001 to 10 mass %, and preferably 0.005 to 5 mass % on a basis of the whole amount of the composition. The total content of these general-purpose additives is preferably 20 mass % or less, more preferably 10 mass % or less, still more preferably 5 mass % or less, and yet still more preferably 2 mass % or less on a basis of the whole amount of the composition.

(Various Physical Properties of Lubricating Oil Composition)

From the viewpoint of fuel consumption reducing properties, a kinematic viscosity at 100° C. of the lubricating oil composition of the present invention is preferably 3.8 to 12.5 $mm^2/s$, more preferably 4.0 to 11.0 $mm^2/s$, still more preferably 4.0 to 9.2 $mm^2/s$, and especially preferably 5.0 to 8.0 $mm^2/s$. Here, the kinematic viscosity at 100° C. is a value as measured using a glass capillary viscometer.

An HTHS viscosity at 150° C. of the lubricating oil composition of the present invention is preferably 1.4 to 5 mPa·s, more preferably 1.4 to 4 mPa·s, and still more preferably 2 to 3 mPa·s.

When the HTHS viscosity at 150° C. is 1.5 mPa·s or more, the lubricating performance can be made favorable, whereas when it is 4 mPa·s or less, not only an excellent viscosity characteristic at a low temperature is obtained, but also excellent fuel consumption properties are obtained. The HTHS viscosity at 150° C. can also be assumed as a viscosity in a high-temperature region at the time of high-speed operation of an engine. When the HTHS viscosity at 150° C. falls within the aforementioned range, it may be said that the lubricating oil composition is favorable in various properties, such as a viscosity in a high-temperature region assuming the time of high-operation of an engine, etc.

The HTHS viscosity at 150° C. is a value of a high temperature high shear viscosity at 150° C. as measured in conformity with ASTM D4741, and specifically, it means a value as obtained by the measurement method described in the Examples.

(Application of Lubricating Oil Composition)

The lubricating oil composition of the present invention is used as an application for a gasoline engine, and it is suitably used especially for a gasoline engine mounted with a direct injection supercharger. When using for such an application, the excellent detergency, fuel consumption reducing properties, and LSPI preventing properties which the lubricating oil composition of the present invention can be effectively applied.

(Production Method of Lubricating Oil Composition)

The production method of a lubricating oil composition of the present invention includes blending a base oil with a calcium detergent and a magnesium detergent and/or a sodium detergent, such that the content of the calcium detergent as converted into a calcium atom is less than 2,000 ppm by mass on a basis of the whole amount of the composition; and a mass ratio of a magnesium atom (Mg) contained in the magnesium detergent and/or a sodium atom (Na) contained in the sodium detergent to a calcium atom (Ca) [(Mg and/or Na)/Ca] is 0.05 to 1.50.

If desire, the lubricating oil composition of the present invention can be produced by blending other components, for example, a poly(meth)acrylate, a succinimide and/or a boron-containing succinimide, an anti-wear agent, an anti-oxidant, a pour-point depressant, a friction modifier, and besides, general-purpose additives. The amount (blending amount) of each of these components to be blended may be properly selected and determined according to the desired performance within the range of the content of each of the components as described above.

Each of the aforementioned components may be blended in the base oil by any method, and its technique is not limited thereto. For example, after separately mixing the calcium detergent and the magnesium detergent and/or the sodium detergent, and furthermore, other additives, this mixture may be blended in the base oil, or these materials may be successively added to and mixed in the base oil. In the latter case, the addition order does not matter.

EXAMPLES

The present invention is hereunder described in more detail by reference to Examples, but it should be construed that the present invention is by no means limited by these Examples. The content of each of atoms of lubricating oil compositions prepared in the Examples and Comparative Examples, the HTHS viscosity at 150° C. and the kinematic viscosity at 100° C. of lubricating oil compositions were measured and evaluated by the following methods.

[Content of Each of Atoms of Lubricating Oil Composition]

(Contents of Calcium Atom, Magnesium Atom, Sodium Atom, Phosphorus Atom, and Boron Atom)

The measurement was performed in conformity with JIS-5S-38-92.

(Content of Nitrogen Atom)

The measurement was performed in conformity with JIS K2609.

[HTHS Viscosity at 150° C. (High Temperature High Shear Viscosity)]

A viscosity after shearing a lubricating oil composition as a measuring object at 150° C. and at a shear rate of $10^6$/s was measured in conformity with ASTM D4741.

[Measurement of Kinematic Viscosity at 100° C.]

A value as measured using a glass capillary viscometer in conformity with JIS K2283-2000.

Examples 1 to 10 and Comparative Examples 1 to 3

In Examples 1 to 10, a base oil and various additives of the kinds and blending amounts shown in Table 1 were blended, and in Comparative Examples 1 to 3, a base oil and various additives of the kinds and blending amounts shown in Table 2 were blended, thereby preparing lubricating oil compositions having an HTHS viscosity at 150° C. of 2.6 mPa·s, respectively.

(Evaluation of Detergency)

With respect to these lubricating oil compositions thus prepared, a hot tube test at 300° C. was performed based on the following method, thereby evaluating the detergency. The results are shown in Tables 1 and 2.

(Hot Tube Test (at 300° C.))

The measurement was performed by setting the test temperature to 300° C. and making other conditions in conformity with those of JPI-5S-55-99. Conforming to JPI-5S-55-99, a lacquer attached to a test tube after the test was evaluated between Point 0 (black) and Point 10 (colorless) and evaluated on 11 grades. It is meant that as the numerical value is larger, a deposit is less, and the detergency becomes better. As for the grade point, Points 7 or more are evaluated to be acceptable.

(LSPI Preventing Performance of Lubricating Oil Composition)

With respect to the lubricating oil composition of each of the Examples and Comparative Examples, a maximum value of a heat flow was measured based on the following method, thereby evaluating the LSPI preventing performance based on the maximum value of the heat flow. The results are shown in Tables 1 and 2.

(Measurement of Maximum Value of Heat Flow)

With respect to the prepared lubricating oil compositions, the generation of a heat flow following a temperature rise was analyzed using a high-pressure differential scanning calorimeter. A material in which 5 mg of a test oil was dropped in an aluminum pan was used as a measurement sample, an aluminum pan in which a test oil was not dropped was used as a standard. An air pressure was set to 10 atm, and the measurement was performed in an air atmosphere. The temperature rise was performed to 400° C. at a rate of 1.0° C./min. In general, when the temperature is raised, a lubricating oil composition causes the momentary heat generation at a specified temperature and burns. As the amount of heat generation on the occasion of causing the momentary heat generation at that time is larger, a combustion reaction is liable to be caused within a combustion chamber, namely LSPI is liable to be induced. Then, a maximum value of the heat flow corresponding to a heat generation rate was determined on a basis of the amount of heat generation on the occasion of causing the momentary heat generation. It may be said that as the maximum value is smaller, the LSPI preventing performance is more favorable. Values of 325.5 mW or less are evaluated to be acceptable.

TABLE 1

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| Composition | Base oil | — | Balance | Balance | Balance | Balance | Balance | Balance | Balance | Balance | Balance | Balance |
| | Detergent A | mass % | 1.90 | 1.90 | 1.90 | 1.90 | 1.90 | 1.90 | 1.90 | 1.90 | 1.00 | 2.30 |
| | Detergent B | mass % | 0.11 | 0.32 | 1.08 | 1.62 | — | — | — | — | 0.32 | 0.32 |
| | Detergent C | mass % | — | — | — | — | 0.05 | 0.15 | 0.51 | 0.77 | — | — |
| | Viscosity index improver | mass % | 10.90 | 10.80 | 10.30 | 10.00 | 10.90 | 10.80 | 10.40 | 10.20 | 11.20 | 10.50 |
| | Pour-point depressant | mass % | 0.20 | 0.20 | 0.20 | 0.20 | 0.20 | 0.20 | 0.20 | 0.20 | 0.20 | 0.20 |
| | Anti-wear agent | mass % | 1.10 | 1.10 | 1.10 | 1.10 | 1.10 | 1.10 | 1.10 | 1.10 | 1.10 | 1.10 |
| | Dispersant A | mass % | 4.00 | 4.00 | 4.00 | 4.00 | 4.00 | 4.00 | 4.00 | 4.00 | 4.00 | 4.00 |
| | Dispersant B | mass % | 2.00 | 2.00 | 2.00 | 2.00 | 2.00 | 2.00 | 2.00 | 2.00 | 2.00 | 2.00 |
| | Antioxidant A | mass % | 0.50 | 0.50 | 0.50 | 0.50 | 0.50 | 0.50 | 0.50 | 0.50 | 0.50 | 0.50 |
| | Antioxidant B | mass % | 1.25 | 1.25 | 1.25 | 1.25 | 1.25 | 1.25 | 1.25 | 1.25 | 1.25 | 1.25 |
| | Other additives | mass % | 0.25 | 0.25 | 0.25 | 0.25 | 0.25 | 0.25 | 0.25 | 0.25 | 0.25 | 0.25 |
| Properties | Calcium content | ppmCa | 1500 | 1500 | 1500 | 1500 | 1500 | 1500 | 1500 | 1500 | 800 | 1800 |
| | Magnesium atom content | ppmMg | 100 | 300 | 1000 | 1500 | — | — | — | — | 300 | 300 |
| | Sodium atom content | ppmNa | — | — | — | — | 100 | 300 | 1000 | 1500 | — | — |

TABLE 1-continued

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| | (Mg + Na)/Ca *1 | — | 0.067 | 0.20 | 0.67 | 1.00 | 0.067 | 0.20 | 0.67 | 1.00 | 0.38 | 0.17 |
| | Nitrogen content *2 | ppmN | 650 | 650 | 650 | 650 | 650 | 650 | 650 | 650 | 650 | 650 |
| | Anti-wear agent | ppmP | 800 | 800 | 800 | 800 | 800 | 800 | 800 | 800 | 800 | 800 |
| | Dispersant A | ppmN | 400 | 400 | 400 | 400 | 400 | 400 | 400 | 400 | 400 | 400 |
| | Dispersant B | ppmN | 250 | 250 | 250 | 250 | 250 | 250 | 250 | 250 | 250 | 250 |
| | HTHS viscosity at 150° C. | mPa · s | 2.6 | 2.6 | 2.6 | 2.6 | 2.6 | 2.6 | 2.6 | 2.6 | 2.6 | 2.6 |
| | Kinematic viscosity at 100° C. | $mm^2/s$ | 7.62 | 7.62 | 7.57 | 7.56 | 7.61 | 7.62 | 7.55 | 7.53 | 7.59 | 7.62 |
| Evaluation | Evaluation of detergency *3 | | 7 | 8 | 8 | 8 | 9 | 9 | 9 | 10 | 7 | 8 |
| | Evaluation of LSPI preventing performance *4 | | 325.4 | 324.5 | 324.2 | 324.2 | 325.3 | 324.5 | 324.2 | 324.0 | 324.4 | 325.1 |

TABLE 2

| | | | Comparative Example | | |
|---|---|---|---|---|---|
| | | | 1 | 2 | 3 |
| Composition | Base oil | — | Balance | Balance | Balance |
| | Detergent A | mass % | 3.10 | 1.90 | 0.40 |
| | Detergent B | mass % | 0.32 | — | 0.87 |
| | Detergent C | mass % | — | — | — |
| | Viscosity index improver | mass % | 10.10 | 11.40 | 11.60 |
| | Pour-point depressant | mass % | 0.20 | 0.20 | 0.20 |
| | Anti-wear agent | mass % | 1.10 | 1.10 | 1.10 |
| | Dispersant A | mass % | 4.00 | 4.00 | 4.00 |
| | Dispersant B | mass % | 2.00 | 2.00 | 2.00 |
| | Antioxidant A | mass % | 0.50 | 0.50 | 0.50 |
| | Antioxidant B | mass % | 1.25 | 1.25 | 1.25 |
| | Other additives | mass % | 0.25 | 0.25 | 0.25 |
| Properties | Calcium content | ppmCa | 2400 | 1500 | 300 |
| | Magnesium atom content | ppmMg | 300 | — | 800 |
| | Sodium atom content | ppmNa | — | — | — |
| | (Mg + Na)/Ca *1 | — | 0.13 | — | 2.67 |
| | Nitrogen content *2 | ppmN | 650 | 650 | 650 |
| | Anti-wear agent | ppmP | 800 | 800 | 800 |
| | Dispersant A | ppmN | 400 | 400 | 400 |
| | Dispersant B | ppmN | 250 | 250 | 250 |
| | Pour-point depressant | ppmN | 420 | 420 | 420 |
| | HTHS viscosity at 150° C. | mPa · s | 2.6 | 2.6 | 2.6 |
| | Kinematic viscosity at 100° C. | $mm^2/s$ | 7.65 | 7.62 | 7.56 |
| Evaluation | Evaluation of detergency *3 | | 8 | 7 | 6 |
| | Evaluation of LSPI preventing performance *4 | | 326.1 | 325.8 | — |

(Note)

The abbreviations and materials used, and so on in Tables 1 and 2 are as follows. ppmCa, ppmMg, ppmNa, ppmP, ppmN, and ppmB express the contents (ppm by mass) as converted into a calcium atom (Ca), a magnesium atom (Mg), a sodium atom (Na), a phosphorus atom (P), a nitrogen atom (N), and a boron atom (B), respectively.

*1 (Mg + Na)/Ca expresses a mass ratio of the magnesium atom (Mg) and/or the sodium atom (Na) to the calcium atom (Ca) [(Mg and/or Na)/Ca].

*2 The nitrogen content is a sum total of the nitrogen contents contained in the dispersants A and B.

*3 The numerical value in the column of evaluation of detergency is a grade point of the hot tube test (at 300° C.).

*4 The numerical value in the column of evaluation of LSPI preventing performance is a value of the maximum value (mW) of the heat flow.

The base oil and various additives used for preparing the lubricating oil composition of each of the Examples and Comparative Examples shown in Tables 1 and 2 are as follows.

Base oil: Mineral oil classified into Group III of the base stock categories of the API, kinematic viscosity at 100° C.=4 $mm^2/s$ Detergent A: Overbased calcium salicylate, base number (by the perchloric acid method): 225 mgKOH/g, calcium content: 7.8 mass %

Detergent B: Overbased magnesium sulfonate, base number (by the perchloric acid method): 410 mgKOH/g, magnesium content: 9.4 mass %, sulfur content: 2.0 mass %

Detergent C: Overbased sodium sulfonate, base number (by the perchloric acid method): 450 mgKOH/g, sodium content: 19.5 mass %, sulfur content: 1.2 mass %

Viscosity index improver: Polymethacrylate (PMA, Mw=430,000, Mn=130,000, Mw/Mn=3.3, resin component concentration: 17 mass %)

Pour-point depressant: Polymethacrylate (PMA, Mw=50,000, Mn=30,000, Mw/Mn=1.7, resin component concentration: 66 mass %)

Anti-wear agent: Primary alkyl ZnDTP (phosphorus content: 7.3 mass %, zinc content: 8.4 mass %)

Dispersant A: Succinimide (polybutenyl succinic acid bisimide), nitrogen content: 1 mass %

Dispersant B: Boron-containing succinimide (boron-containing polybutenyl succinic acid bisimide), nitrogen content: 1.23 mass %, boron content: 1.3 mass %

Antioxidant A: Hindered phenol-based antioxidant

Antioxidant B: Diphenylamine-based antioxidant

Others: Defoaming agent and metal deactivator

As shown in Table 1, it was confirmed that in the lubricating oil compositions of the Examples, the grade point of the hot tube test is high as 7 to 10, and the maximum value of the heat flow is 325.5 mW or less, and hence, the lubricating oil compositions of the Examples are excellent in not only detergency and LSPI preventing performance.

On the other hand, as shown in Table 2, it was confirmed that in the lubricating oil composition of Comparative Example 1 in which the calcium detergent was excessively added, the maximum value of the heat flow is 326.1 mW, a value of which is more than 325.5 mW, and hence, the lubricating oil composition of Comparative Example 1 is inferior in LSPI preventing performance; and that the lubricating oil composition of Comparative Example 2 not containing the magnesium detergent and the sodium detergent is inferior in LSPI preventing performance. In addition, it was confirmed that in the lubricating oil composition of Comparative Example 3 in which the magnesium detergent was excessively contained, the grade point of the hot tube test is low as 6, and hence, the lubricating oil composition of Comparative Example 3 is inferior in detergency.

The invention claimed is:

1. A method, comprising lubricating a gasoline engine using a lubricating oil composition comprising:

a base oil;

a calcium salicylate; a magnesium sulfonate; a boron-containing succinimide; and optionally a non-borated succinimide, wherein:

at least 220 ppm by mass of boron from the boron-containing succinimide is present;

a content of the base oil is 70 mass % or more based on a whole amount of the composition;

the calcium salicylate is the only calcium detergent present in the lubricating oil composition and a content of the calcium salicylate as converted into a calcium atom content is 800 to less than 2,000 ppm by mass based on the whole amount of the composition;

the magnesium sulfonate is the only magnesium detergent present in the lubricating oil composition and a content of the magnesium sulfonate as converted to a magnesium atom content is 100 to 1,500 ppm by mass based on the whole amount of the composition;

a mass ratio of the magnesium atom content, to the calcium atom content is 0.05 to 1.00;

a content of nitrogen in the lubricating oil composition is less than 0.16 mass %;

the lubricating oil composition has a kinematic viscosity at 100° C. of 3.8 to 12.5 $mm^2/s$;

wherein a maximum value of a heat flow of the lubricating oil composition is 325.5 mW or less, based on an amount of heat flow that occurs following a temperature rise from ambient temperature to 400° C. at a rate of 10° C./min, when 5 mg of the lubricating oil composition is applied to an aluminum pan, and a high-pressure differential scanning calorimeter is used to measure the heat flow at an air pressure of 10 atm; and a score of the hot tube test at 300° C. of the lubricating oil composition measured based on JPI-5S-55-99 is 7 or more.

2. The method according to claim 1, wherein the lubricating oil composition further comprises:

a poly(meth)acrylate.

3. The method according to claim 1, wherein the content of the calcium salicylate in the lubricating oil composition, as converted into the calcium atom content, is 800 to 1,500 ppm by mass based on the whole amount of the composition.

4. The method according to claim 1, wherein the content of the magnesium sulfonate as converted to the magnesium atom content is 300 to 1000 ppm by mass or more based on the whole amount of the composition.

5. The method according to claim 1, wherein the lubricating oil composition comprises the non-borated succinimide and the boron-containing succinimide.

6. The method according to claim 5, wherein the content of nitrogen in the lubricating oil composition is 0.01 mass % or more to less than 0.16 mass %.

7. The method according to claim 5, wherein the lubricating oil composition comprises 600 ppm by mass or less of the boron-containing succinimide as converted into a boron atom content based on the whole amount of the composition.

8. The method according to claim 1, wherein a total base number of the magnesium sulfonate in the lubricating oil composition, by the perchloric acid method as prescribed in JIS K2501, is 150 to 650 mg/KOH.

9. The method according to claim 1, wherein the base oil is at least one selected from the group consisting of a mineral oil and a synthetic oil which are classified into Groups 3 to 5 of the base stock categories of the API (American Petroleum Institute).

10. The method according to claim 1, wherein the kinematic viscosity at 100° C. of the lubricating oil composition is 4.0 to 11.0 $mm^2/s$.

11. The method according to claim 1, wherein the calcium salicylate consists of an overbased calcium salicylate.

12. A lubricating oil composition, comprising a base oil;

a calcium salicylate; a magnesium sulfonate; a boron-containing succinimide; and optionally a non-borated succinimide, wherein:

at least 220 ppm by mass of boron from the boron-containing succinimide is present;

a content of the base oil is 70 mass % or more based on a whole amount of the composition;

the calcium salicylate is the only calcium detergent present in the lubricating oil composition and a content of the calcium salicylate as converted into a calcium atom content is 800 to less than 2,000 ppm by mass based on the whole amount of the composition;

the magnesium sulfonate is the only magnesium detergent present in the lubricating oil composition and a content of the magnesium sulfonate as converted to a magnesium atom content is 100 to 1,500 ppm by mass based on the whole amount of the composition;

a mass ratio of the magnesium atom content, to the calcium atom content is 0.05 to 1.00;

a content of nitrogen in the lubricating oil composition is less than 0.16 mass %;

the lubricating oil composition has a kinematic viscosity at 100° C. of 3.8 to 12.5 $mm^2/s$;

a total content of non-borated succinimide and boron-containing succinimide, as converted into a nitrogen atom, is less than 0.07 mass %;

wherein a maximum value of a heat flow of the lubricating oil composition is 325.5 mW or less, based on an amount of heat flow that occurs following a temperature rise from ambient temperature to 400° C. at a rate of 10° C./min, when 5 mg of the lubricating oil composition is applied to an aluminum pan, and a high-pressure differential scanning calorimeter is used to measure the heat flow at an air pressure of 10 atm; and a score of the hot tube test at 300° C. of the lubricating oil composition measured based on JPI-5S-55-99 is 7 or more.

* * * * *